US006935600B1

(12) United States Patent
Barrepski

(10) Patent No.: US 6,935,600 B1
(45) Date of Patent: Aug. 30, 2005

(54) SUSPENSION HOLDING DEVICE AND METHOD OF USE

(76) Inventor: Christopher R. Barrepski, 9 Edgewood Rd., Ellington, CT (US) 06029

( * ) Notice: Subject to any disclaimer, the term of this patent is extended or adjusted under 35 U.S.C. 154(b) by 15 days.

(21) Appl. No.: 10/794,875

(22) Filed: Mar. 8, 2004

Related U.S. Application Data

(60) Provisional application No. 60/482,240, filed on Jun. 26, 2003.

(51) Int. Cl.[7] ..... A47G 29/02

(52) U.S. Cl. ..... 248/217; 248/235; 248/247; 211/113; 211/117; 211/118; 312/245; 108/42

(58) Field of Search ..... 248/235, 250, 248/201, 317, 247, 300, 205.3; 211/113, 211/117, 118, 85.29; 182/150; 108/149, 101, 108/182, 187, 155, 42; 312/245, 101, 236

(56) References Cited

U.S. PATENT DOCUMENTS

| | | | | | |
|---|---|---|---|---|---|
| 959,437 | A | * | 5/1910 | Martin | 52/658 |
| 1,442,697 | A | * | 1/1923 | Orthmann | 182/129 |
| 1,506,865 | A | * | 9/1924 | Robinson | 254/343 |
| 1,566,551 | A | * | 12/1925 | Bebb | 108/182 |
| 1,663,151 | A | * | 3/1928 | Armstrong | 248/247 |
| 1,738,030 | A | * | 12/1929 | Bebb | 432/259 |
| 2,043,864 | A | * | 6/1936 | Novak | 182/55 |
| 2,070,334 | A | * | 2/1937 | Garber | 362/253 |
| 2,582,385 | A | * | 1/1952 | Knudsen | 182/113 |
| 2,661,677 | A | * | 12/1953 | Lingelbach | 454/331 |
| 2,790,184 | A | | 4/1957 | Testa | |
| 3,637,047 | A | * | 1/1972 | Cox | 182/222 |
| 4,029,173 | A | * | 6/1977 | Wakabayashi | 182/150 |
| 4,061,092 | A | | 12/1977 | Jacobsen et al. | |
| 4,175,360 | A | * | 11/1979 | Mulvey | 52/28 |
| 4,311,243 | A | * | 1/1982 | Hui-Lai | 211/113 |
| 4,366,774 | A | | 1/1983 | Haake et al. | |
| D270,977 | S | | 10/1983 | Kneale, III | |
| 4,424,908 | A | | 1/1984 | Davitz | |
| 4,651,963 | A | * | 3/1987 | Busse et al. | 248/323 |
| 4,682,807 | A | * | 7/1987 | Mulligan | 294/161 |
| 4,726,317 | A | * | 2/1988 | Ritten et al. | 114/362 |
| 4,749,060 | A | * | 6/1988 | Vandelinde | 182/222 |
| 5,048,640 | A | * | 9/1991 | McConville et al. | 182/36 |
| 5,127,619 | A | | 7/1992 | Bleim | |
| 5,127,620 | A | | 7/1992 | Bleim et al. | |
| 5,263,677 | A | * | 11/1993 | Puerner | 248/370 |
| 5,350,071 | A | * | 9/1994 | Pond | 211/70.6 |
| 6,145,678 | A | | 11/2000 | Morrison | |

(Continued)

*Primary Examiner*—Kimberly Wood
(74) *Attorney, Agent, or Firm*—Deborah A. Basile; Karen K. Chadwell

(57) ABSTRACT

Disclosed herein is a support component for suspending a load, comprising: a main body, wherein the main body comprises: a hollowed portion bordered by a top side wall opposite to a bottom side wall, and a proximal lateral side wall opposite to a distal lateral side wall, wherein the proximal and distal lateral side walls join the top side wall to the bottom side wall; a top surface extending perpendicularly outward from the top side wall; and an extension element extending perpendicularly outward from the bottom side wall. Further disclosed herein is a suspension holding device suitable for suspending loads from a hanging element and a method of use.

16 Claims, 3 Drawing Sheets

U.S. PATENT DOCUMENTS 6,161,709 A * 12/2000 Kluge et al. ..... 211/117
6,212,705 B1 4/2001 Kramer
6,286,691 B1 9/2001 Oberhaus et al.
6,515,224 B1 2/2003 Pedro
6,640,924 B2 * 11/2003 Messner ..... 181/144
2002/0063102 A1 5/2002 Hanneken

* cited by examiner

SUSPENSION HOLDING DEVICE AND METHOD OF USE

CROSS REFERENCE TO RELATED APPLICATIONS

This application claims the benefit of U.S. Provisional Application No. 60/482,240 filed on Jun. 26, 2003.

BACKGROUND OF THE INVENTION

Installing heavy equipment, such as air conditioners, is currently time consuming and laborious requiring a wide number of parts. Little has been done to ease installation. Therefore, what is currently needed is a device to ease the installation process of heavy equipment, such as air conditioners, and to reduce the number of materials currently necessary for installation.

SUMMARY OF THE INVENTION

The above-discussed and other drawbacks and deficiencies of the prior art are overcome or alleviated by a support component for suspending a load, comprising: a main body, wherein the main body comprises: a hollowed portion bordered by a top side wall opposite to a bottom side wall, and a proximal lateral side wall opposite to a distal lateral side wall, wherein the proximal and distal lateral side walls join the top side wall to the bottom side wall; a top surface extending perpendicularly outward from the top side wall; and an extension element extending perpendicularly outward from the bottom side wall. Further the drawbacks of the prior art are alleviated by a suspension holding device suitable for suspending loads from a hanging element and a method of use as disclosed herein.

DETAILED DESCRIPTION OF THE INVENTION

In general, disclosed herein is a suspension holding device. More particularly, disclosed herein is a suspension holding device for supporting a load, wherein the suspension holding device is well adapted to securely suspend loads from the ground. Even more particularly, disclosed herein is a suspension holding device capable of supporting a load from a beam or a rafter, e.g., a ceiling rafter, wherein the load may be any object meeting the capacity requirements of the suspension holding device, and wherein a particularly preferred load is an air conditioning unit.

In general, the suspension holding device comprises a support element, wherein the support element comprises at least one, preferably, at least two, support components. The support element may comprise any material having sufficient rigidity and durability to support a desired load. Preferably, the support element comprises wood, metal, plastic, and the like. In a particularly preferred embodiment, the support element comprises 18 gauge galvanized sheet metal. The support component(s) forming the support element may comprise a wide variety of shapes, sizes, and geometrical configurations. However, in a preferred embodiment, the support component is specifically configured to fit on hanging element, such as a beam or a rafter such as is typically found in attic ceilings.

The suspension holding device may further comprise a pan, wherein the pan comprises any material of sufficient durability for the pan's intended application. When the load is an air conditioning unit, a particularly preferred pan comprises a condensate drain pan.

The suspension holding device may further comprise an adhesive disposed between the support component(s) and the pan, or between the support component(s) and the load to be supported, wherein the adhesive serves as a binding agent to provide greater structural support to the suspension holding device. Exemplary adhesives comprise high-density double sided sticky tape foam, construction adhesives, vibration mounting pads and devices, and the like.

The suspension holding device may further comprise one or more hangers for suspending the suspension holding device from a hanging element, wherein the hanging element may comprise a beam or rafter, such as those commonly found in attic roof rafters and ceilings. The hanger(s) may comprise a wide variety of materials including metal, plastic, rope, and the like. The length of the hanger may vary depending on the desired position of the load and the slope of the surface of the hanging element from which the suspension holding device will hang.

Figure 1:
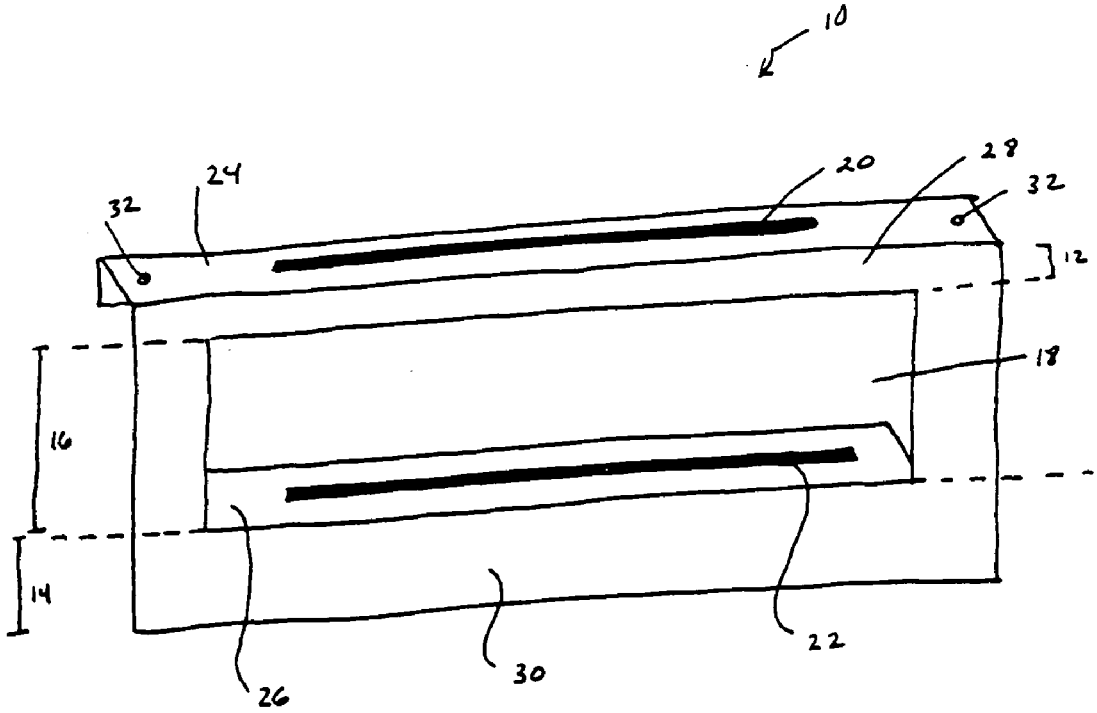
FIG. 1 is a schematic of an exemplary support component for a suspension holding device.
Figure 2:
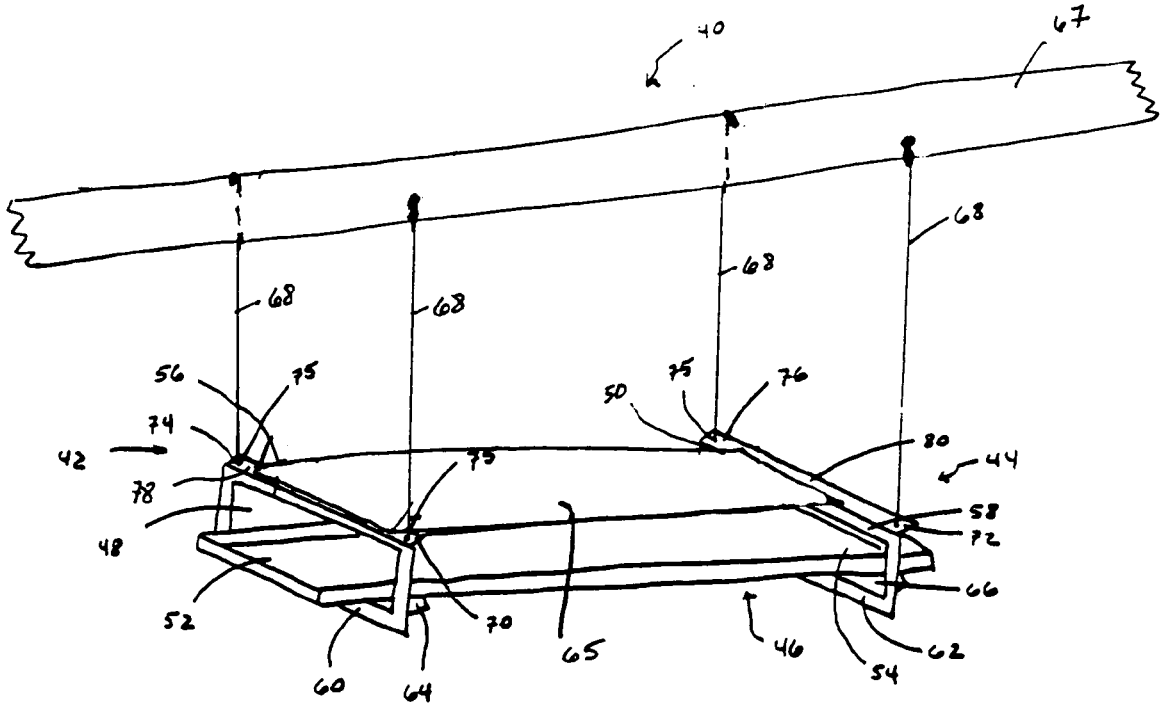
FIG. 2 is a schematic of an exemplary assembly for suspending a load from a hanging element.
Figure 3:
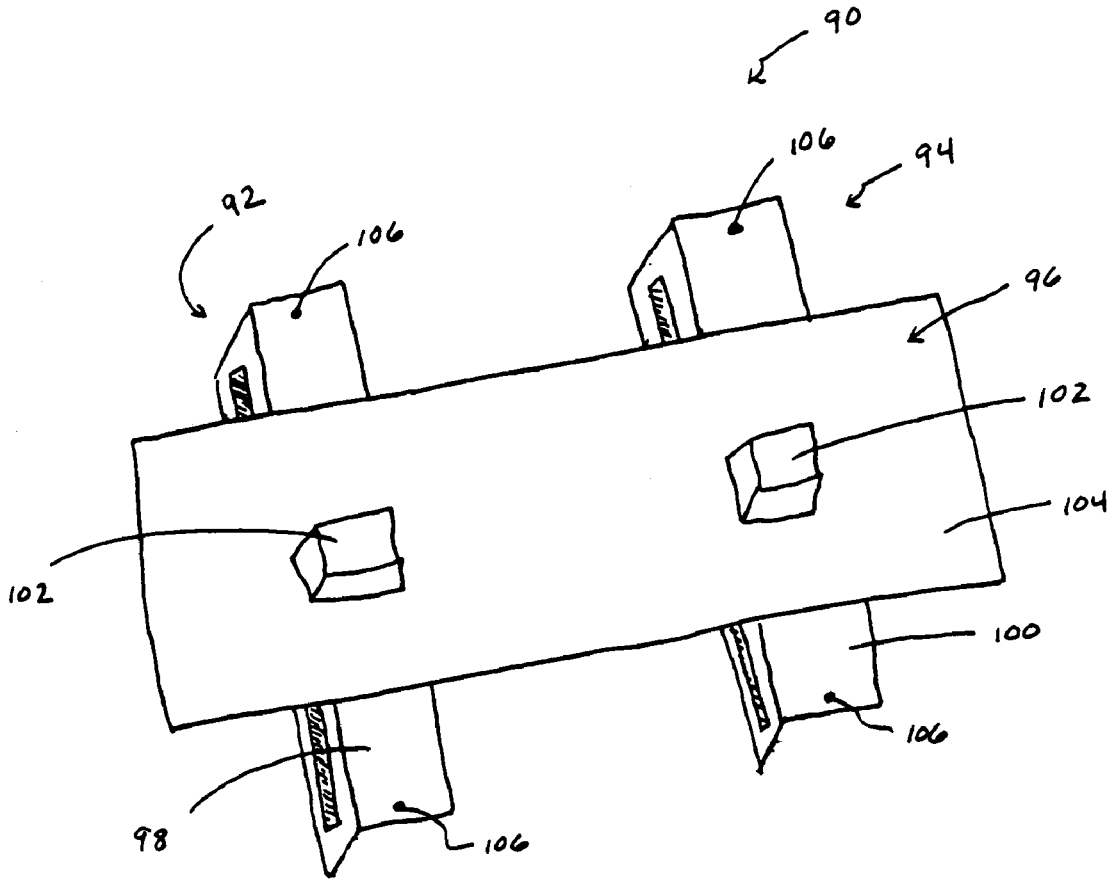
FIG. 3 is a schematic of a top view of another exemplary suspension holding device.

Exemplary embodiments of the suspension holding device and its components are depicted in FIGS. 1–3. Although the exemplary embodiments are made in reference to FIGS. 1–3, these Figures are in no way limiting, and slight variations and modifications to these figures are contemplated.

As previously stated, the suspension holding device comprises a support element, wherein the support element may comprise one or more support components. FIG. 1 depicts an exemplary support component. Here, a support component 10 comprises a top portion 12 and a bottom portion 14 separated by a middle portion 16, wherein middle portion 16 comprises a hollowed portion 18. Top portion 12 comprises a top surface 24, which extends outwardly from a top side wall 28. Preferably, top surface 24 is perpendicular to a top edge of top side wall 28. Bottom portion 14 comprises an extension element 26, which is preferably perpendicular to a bottom side wall 30. Extension element 26 is preferably joined to a top edge of bottom side wall 30, and extends outwardly from bottom side wall 30 such that top surface 24 and extension element 26 are in horizontal alignment. It can also be conceived that the extension element can be bent in the opposite direction to achieve the same result. The support element can be built either way.

Adhesives 20, 22 may be disposed on top surface 24 and on extension element 26. Although shown on both top surface 24 and extension element 26, it is contemplated that the adhesive may only be disposed on one of these elements. Additionally, rather than a continuous strip, the adhesive may comprise a discontinuous strip or it may be positioned and dimensioned in a wide variety of manners so long as it is capable of securing a pan or a load onto the suspension holding device.

Support component 10 may comprise a wide variety of geometrical shapes and sizes. However, in a preferred embodiment, support component 10 comprises a height of up to about 13 inches, with up to about 7.5 inches more preferred, and up to about 6.5 inches especially preferred. Preferably, hollowed portion 18 comprises a height of about 1.5 to about 8 inches, with about 3 inches more preferred. Additionally, a top side wall 28 preferably comprises a height of about 1 inch to about 3 inches, with about 2.0 inches more preferred. A bottom side wall 30 preferably comprises a height of about 0.5 inch to about 2 inches, with about 1 inch more preferred. Furthermore, top surface 24 and/or extension element 26 preferably comprises a width of about 1.5 to about 4 inches, with about 2 to about 3 inches more preferred, with about 2.5 inches especially preferred.

As shown in FIGS. 2 and 3, exemplary suspension holding devices may comprise a support element comprising at least two support components, wherein the support components are identical to or similar to that described above in reference to FIG. 1. For example, FIG. 2 depicts a suspension holding device 40 comprising two support components 42, 44 such as that described in reference to FIG. 1. Furthermore, suspension holding device 40 comprises an optional pan 46 disposed between support components 42, 44. Support components 42, 44 each comprises a hollowed portion 48, 50 respectively through which ends 52, 54 of pan 46 extend. Hollowed portions 48, 50 are bordered, in part, by top side walls 56, 58 and by bottom side walls 60, 62 respectively. At least one of support components 42, 44 may further comprise an adhesive (not shown) disposed on at least a portion of at least one of extension elements 64, 66, such that a bottom surface of pan 46 in contact with the adhesive is further secured to suspension holding device 40.

Suspension holding device 40 further comprises hangers 68 attached to proximal 70, 72 and distal 74, 76 end portions of respective support components 42, 44. Hangers 68 can be used to suspend suspension holding device 40 from a hanging element 67, wherein hanging element 67 may comprise, for example, a beam, a rafter, a ceiling, etc. It is contemplated that any number of hangers may be attached to a single support component at any point on the support component so long as the support component remains balanced and secured when the suspension holding device is suspended and a load is disposed onto the suspension holding device.

Although the length of each hanger 68 may vary depending on the desired position of the load and the slope of the surface from which the suspension holding device will hang, each hanger 68 preferably comprises a length of about 10 inches to about 72 inches, with a length of about 20 inches to about 60 inches more preferred, and about 24 inches to about 48 inches especially preferred.

Hangers 68 may be attached to support components 42, 44 by a wide variety of means. For example, holes (as shown in FIG. 1 by reference numeral 32) may be formed through top surfaces 78, 80 at proximal end portions 70, 72 and distal end portions 74, 76 respectively such that a first end of hanger 68 may be inserted through the hole and then bent or knotted such that the first end will not disengage from the respective support component. Alternatively, hangers 68 may be secured to their respective support component by means of nuts, washers, screws, and the like for example.

Hanger 68 may be formed in a wide variety of ways such that a free end of hanger 68 is capable of securing suspension holding device 40 from a beam, rafter, ceiling, etc. In a preferred embodiment, the free end of hanger 68 comprises a hook structure (not shown) capable of hooking onto a rafter or beam. Alternatively, the free end of hanger 68 may be tied around, nailed to, screwed onto, or welded onto the beam or rafter.

Once suspension holding device 40 is secured onto a hanging element, a load 65 may be positioned, balanced, and secured onto top surfaces 78, 80, with, or without the assistance of an adhesive. Alternatively, a load 65 may be disposed onto pan 46. Where for whatever reason, it is undesirable for the load to directly rest on pan 46, a buffer element may be disposed between the load and the pan. The buffer element may be any structure capable of supporting the force of the load and which separates the load from the pan, and may include an adhesive (such as shown in FIG. 3).

An alternative embodiment of a suspension holding device is depicted in FIG. 3. Here, a suspension holding device 90 comprises support components 92, 94 identical to or similar to that described in reference to FIG. 1. Suspension holding device 90 further comprises a pan 96 disposed onto a top surface 98, 100 of respective support components 92, 94. An adhesive (not shown) may be disposed between pan 96 and at least one of top surfaces 98, 100. Additionally, suspension holding device 90 comprises an optional adhesive 102 disposed onto a surface 104 of pan 96. Although FIG. 3 depicts optional adhesive 102 as two blocks of adhesive, wherein each block is aligned with the central point of top surfaces 98, 100 respectively, it is contemplated that optional adhesive 102 may comprise a continuous single piece of adhesive, or any number of pieces of adhesive, such that the load to be suspended is both secured and balanced when placed onto the pan. Optional adhesive 102 secures a load (not shown) to pan 96 while preventing actual physical contact between pan 96 and the load. Optional adhesive 102 preferably comprises a double-sided sticky tape, wherein the sticky portions are in contact with surface 104 and the load.

Although not shown, hangers, such as those described above in reference to FIG. 2, may be attached to holes 106 formed on top surfaces 98, 100. Such hangers may be attached to a hanging element as described above in reference to FIG. 2.

The suspension holding devices disclosed herein contain several advantages over the prior art. First, fewer accessory parts are required for installing heavy pieces of equipment. Second, installation can be accomplished in few steps, as the suspension holding device can be pre-assembled to fit standard rafters. Third, the holding device can securely hold heavy loads in a convenient and unobtrusive fashion, wherein each support component can support up to about 500 pounds. Additionally, where the support component comprises thick gauge metal of about 0.25 inch to about 0.375 inch or more, the weight limit which the support component can support may increase considerably.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An assembly for suspending a load from a hanging element comprising:

a hanging element;

a first support component and a second support component, wherein each of the first and second support components comprises a top side wall and a bottom side wall, wherein the top side wall is opposite to the bottom side wall, and further wherein each of the top and bottom side walls comprises a body bordered by a top edge opposite to a bottom edge and a first lateral edge opposite to a second lateral edge;

a proximal lateral side wall, wherein the proximal lateral side wall joins the first lateral edge of the top side wall to the first lateral edge of the bottom side wall;

a distal lateral side wall, wherein the distal lateral side wall joins the second lateral edge of the top side wall to the second lateral edge of the bottom side wall;

a hollowed portion bordered by the bottom edge of the top side wall, the top edge of the bottom side wall, the proximal lateral side wall, and the distal lateral side wall;

a top surface joined to the top side wall, wherein the top surface extends outwardly from the top side wall; and an extension element joined to the bottom side wall, wherein the extension element extends outwardly from the bottom side wall;

a first hanger having a first terminal end opposite to a second terminal end, wherein the first terminal end is attached to the hanging element, and the second terminal end is attached to the top surface of the first support component;

a second hanger having a first terminal end opposite to a second terminal end, wherein the first terminal end is attached to the hanging element, and the second terminal end is attached to the top surface of the second support component; and load is supported by the top surfaces of the first support component and the second support component.

2. The assembly of claim 1, further comprising a pan, wherein the pan is positioned between and disposed on the extension elements of the first and second support components.

3. The assembly of claim 2, further comprising a first adhesive disposed on the top surface of the first support component and a second adhesive disposed on the top surface of the second support component, wherein the load is disposed on the first adhesive and on the second adhesive.

4. The assembly of claim 2, further comprising a first adhesive disposed between the pan and the extension element of the first support component and a second adhesive disposed between the pan and the extension element of the second support component.

5. The assembly of claim 1, further comprising a pan disposed onto and between the top surfaces of the first and second support components wherein the load is disposed on the pan.

6. The assembly of claim 5, wherein a first adhesive is disposed between the pan and the top surface of the first support component, and wherein a second adhesive is disposed between the pan and the top surface of the second support component, wherein the load is disposed on a side of the pan opposite to the first and second adhesives.

7. The assembly of claim 1, wherein the hanging element comprises a ceiling beam or a rafter.

8. The assembly of claim 1, wherein:

the top surfaces of the first and second support components are each joined perpendicularly to the top edges of the respective top side walls; and wherein the extension elements of the first and second support components are each joined perpendicularly to the top edges of the respective bottom side walls.

9. The assembly of claim 3, wherein the load is an air conditioning unit and wherein the pan is a condensation pan.

10. An assembly for suspending a load comprising:

a suspension holding device suspending from a hanging element, wherein the suspension holding device comprises:

a first support component and a second support component, wherein each of the first and second support components comprises:

a top side wall and a bottom side wall, wherein the top side wall is opposite to the bottom side wall, and wherein each of the top and bottom side walls comprises a body bordered by a top edge opposite to a bottom edge and a first lateral edge opposite to a second lateral edge;

a proximal lateral side wall, wherein the proximal lateral side wall joins the first lateral edge of the top side wall to the first lateral edge of the bottom side wall;

a distal lateral side wall, wherein the distal lateral side wall joins the second lateral edge of the top side wall to the second lateral edge of the bottom side wall;

a hollowed portion bordered by the bottom edge of the top side wall, the top edge of the bottom side wall, the proximal lateral side wall, and the distal lateral side wall;

a top surface comprising a main body, wherein the main body comprises a proximal end opposite to a distal end, and wherein the main body is bordered in part by an upper edge opposite to a lower edge, wherein the lower edge is joined to the top side wall;

an extension element comprising a main body bordered in part by an upper edge opposite to a lower edge, wherein the lower edge is joined to the bottom side wall; and a plurality of hangers, wherein at least a first hanger and a second hanger from the plurality of hangers each comprises a first end opposite to a second end, wherein the first end of the first hanger is attached to the top surface of the first support component and the first end of the second hanger is attached to the top surface of the second support component;

wherein hanging is accomplished by attaching the second end of each of the first and second hangers to the hanging element; and the load supported by the top surfaces of the first support component and the second support component.

11. The assembly of claim 10, wherein the load is positioned onto and between the top surfaces of the first support component and the second support component.

12. The assembly of claim 11, further comprising disposing a pan onto and between the extension elements of the first support component and the second support component.

13. The assembly of claim 10, wherein the plurality of hangers further comprises a third hanger and a fourth hanger, wherein each of the third and fourth hangers comprises a first end opposite to a second end, wherein:

the first end of the first hanger is attached to the proximal end of the top surface of the first support component;

the first end of the second hanger is attached to the proximal end of the top surface of the second support component;

the first end of the third hanger is attached to the distal end of the top surface of the first support component;

the first end of the fourth hanger is attached to the distal end of the top surface of the second support component; and the second ends of the first, second, third, and fourth hangers are attached to the hanging element.

14. The assembly of claim 10, wherein:

the upper edge of each of the top surfaces of each of the first and second support components is joined perpendicularly to the top edge of the respective top side wall; and the lower edge of each of the extension elements of each of the first and second support components is joined perpendicularly to the top edge of the respective bottom side wall.

15. The assembly of claim 12, further comprising disposing a first adhesive between the load and the top surface of the first support component and disposing a second adhesive between the load and the top surface of the second support component.

16. The assembly of claim 15, wherein the load is an air conditioning unit and wherein the pan is a condensation pan.

* * * * *